United States Patent [19]

Eich

[11] Patent Number: 4,578,913

[45] Date of Patent: Apr. 1, 1986

[54] FIRE PROTECTION PARTITION WALL

[76] Inventor: August Eich, Am Berge 21, 5810 Witten-Herbede, Fed. Rep. of Germany

[21] Appl. No.: 568,806

[22] Filed: Jan. 6, 1984

[30] Foreign Application Priority Data

Jan. 22, 1983 [DE] Fed. Rep. of Germany ..... 3302044

[51] Int. Cl.[4] ..... E04B 1/62; E04B 2/62

[52] U.S. Cl. ..... 52/206; 52/238.1; 52/772

[58] Field of Search ..... 52/727, 205, 206, 106, 52/241, 232, 235, 238, 398, 790, 476, 772, 780

[56] References Cited

U.S. PATENT DOCUMENTS

| | | | |
|---|---|---|---|
| 2,034,265 | 3/1936 | McLaughlin | 52/206 |
| 2,078,491 | 4/1937 | Graham | 52/241 |
| 2,351,015 | 6/1944 | Davison | 52/206 |
| 3,538,658 | 11/1970 | LaValley | 52/232 |
| 4,164,108 | 8/1979 | Ortmanns | 52/232 |

FOREIGN PATENT DOCUMENTS

| | | | |
|---|---|---|---|
| 3027439 | 2/1982 | Fed. Rep. of Germany | 52/232 |
| 2067639 | 7/1981 | United Kingdom | 52/232 |

OTHER PUBLICATIONS

Kidder-Parker Architects' and Builders' Handbook 18th Edition, 1931, pp. 922, 923, 926, 927, 928, 929, 930, 931.

*Primary Examiner*—John E. Murtagh
*Attorney, Agent, or Firm*—Michael J. Striker

[57] ABSTRACT

Disclosed is a fire protection dividing wall for installation between construction parts of a building. The wall is assembled of a supporting frame carrying fire protection glass panes. The frame is assembled of a steel core which includes upright struts and horizontal tie bars which carry the glass panes. The frame core is preferably made of steel tubes of rectangular cross section. The struts are provided with opposite projections which are inserted into the ends of the tie bar sections. The opposite outer sides of the frame cores are covered with covering rails of hard wood, which has approximately the same fire-resistant time factor as the glass panes. The gaps between the covering rails and the glass panes are sealed by a fire-resistant sealing mass.

29 Claims, 11 Drawing Figures

FIRE PROTECTION PARTITION WALL

BACKGROUND OF THE INVENTION

This invention relates to a fire protection partition wall which includes a supporting frame completely embedding the periphery of a fire protection glass plane, the supporting frame being adapted for installation between construction parts of a framework or a foundation, the glass pane being provided along its periphery with fire protection insulation, and the junctions between the glass pane and the supporting frame being sealed by a sealing mass.

Dividing partitions of this kind are installed as part of fire deflecting measures in all places of a building where, for safety reasons, the structure is divided into individual fire protection sections in such a manner that the visibility between the sections be preserved without substantial obstacles. Accordingly, an essential part of such fire protection dividing partitions are the fire protection glass panes which, depending on the desired time factor of their fire resistance, consist of several silicate glass panes between which fire protection layers are disposed. In the case of fire, the outermost glass panes, which face the fire, break first. Thereupon the laminated fire protection layers start foaming and withdraw heat in the process. However, the foaming takes place only then when the protection layer attains a certain temperature. As a consequence, the foaming process is initiated only after direct exposure to the source of heat, and the sources of fire can be at least partially observed through the remaining transparent fire protection glass panes.

Conventional supporting frames embodying the circumferential parts of a fire protection glass include angular sections formed of steel sheets between which the periphery of the fire protection glass panes is interposed and resistant insulation is clamped. The steel sheet profiles are connected one to another, and their outer surfaces are lined either by a blend of hard wood or by a blend of other fire-resistant materials. The fire protection glass panes framed in this manner are integrated into complete fire-obstructing partitions.

However, in standard fire protection dividing walls of light construction (no concrete or the like), the aforedescribed supporting frames can be superposed one on the other only in the case where the completed partition does not exceed the standard height of a room in the building, and also when the overall area of glass panes is relatively small. Specifically, the standard height of a glass pane corresponds for example to a third of the standard height of a room.

As a consequence, in conventional dividing walls it is possible to employ in respective ranges the protection glass pane in the form of a window. The optical transparency of such window-like partitions is limited, and the desired visibility through large areas of the fire protection sections of the building is not obtained.

SUMMARY OF THE INVENTION

It is therefore a general object of the present invention to overcome the aforementioned disadvantages.

More particularly, it is an object of the invention to provide an improved fire protection dividing wall which is suitable for dividing spaces of a supernormal size, such as for example higher and longer walls of hotel halls, or dispatching halls on airports.

A further object of the invention is to provide such an improved partition which can be employed for dividing large spaces into individual fire protection sections, whereby the transparency through such large-area partitions is preserved.

Still another object of this invention is to provide such an improved fire protection partition which is simple to install and which can be additionally installed into completed buildings.

In keeping with these objects and others which will become apparent hereafter, one feature of the invention resides, in a fire protection dividing partition, in a combination which comprises a supporting frame including a steel core assembled of upright struts engageable between two construction parts, and of horizontal tie bars connected between the struts to support the glass pane, and covering rails provided at opposite outer sides of the core to cover the joints between the struts and the tie bars, the covering rails overlapping the edges of the glass pane and being made of a material which has approximately the same fire resistance as the glass pane.

The steel core of the supporting frame thus represents a highly loadable support structure of a grid-like configuration. In this manner it is possible to employ not only large-size fire protection glass panes, but also an arbitrary number of such large-size fire protection glasses can be arranged side-by-side and one above the other between the vertical struts and the horizontal ties bars. Accordingly, using fire protection dividing partitions of this invention, there is no problem to separate large-volume halls such as dispatching halls in airports into desired fire sections, to create in this manner escape and rescue routes or safety zones. The steel core of the frame is designed such that it can be assembled in advance and only simple installation work is needed on the construction site, without the necessity of using manipulation tools or devices or additional building materials. The struts can be clamped between the ceiling construction and the floor construction of a framework in full length, that is, as a single piece. The tie bars are connected between the individual struts, and thereupon the fire protection glass panes are seated in the openings between the struts and tire bars and fixed in position. For fixing purposes, the outer sides of the struts and the tie bars can be provided with covering rails. Any direct contact between the fire protection glass panes and the struts and tie bars is avoided, particularly by using wooden seat blocks and lateral spacers. The shape of covering rails can be diversified. Accordingly, they may be intentionally incorporated in the inner architecture of the space which is equipped with the separation walls. It should only be ensured that the covering rails be made of a material which has the same fire-resisting time factor or about the same fire resistance as the fire protection glass panes. In this way it is prevented that the clamping areas of the glass panes become weak points in the fire protection system of the dividing walls.

According to another feature of this invention, the upright struts and the horizontal tie bars are formed of profiled steel tubes. The steel tube profiles guarantee namely a relatively light weight and a high bending and twisting strength. These qualities will be particularly appreciated in the case of high and long dividing walls. Furthermore, such profiled steel core facilitates the handling both during the manufacture and particularly during the installation of the dividing walls.

The bending and twisting rigidity is further increased when the tubular steel struts and tie bars are of a rectangular cross section and when the central plane of each strut and tie bar coincides with the central plane of the glass panes. Preferably, the longitudinal edges of the rectangular steel pipes are rounded, so that they can be manipulated during the installation without any danger of injury. The struts and the tie bars have the same cross section, and therefore a uniform steel tube can be used.

Preferably, the ratio between the breadth of the narrow sides of the rectangular steel tubes to the breadth of the broader side is about 2:3. It is also of advantage when the wall thickness of the steel pipe is about 1/10 of the breadth of the narrow side.

According to still another feature of this invention, two opposite walls of the upright struts are provided with projecting supports which fit the end portions of assigned horizontal tie bars. After erecting one strut, the tubular tie bars are inserted on the projecting supports, and thereafter the subsequent strut is erected and the projecting supports are inserted into the free ends of the tubular bars. Of course, it is also possible, especially during the installation of a small-size dividing wall, to attach the tubular tie bars to the supporting projections when the entire construction is laid on a floor, and then the completed dividing wall is erected and clamped between the ceiling and floor edges of the framework of the building.

According to this invention it is also advantageous when the projecting supports have a U-shaped configuration made of flat iron or steel sheets. The U-shaped pieces are bent in such a manner that the ends of tubular tie bars are insertable thereon without force; nevertheless without substantial play. The U-shaped supports are connected to the upright struts in the range of the yokes. Preferably, each support is fastened to the strut by two bolts and nuts, to prevent rotation. The threaded bolts pass through corresponding openings in the narrow sides of the struts, which are spaced apart from one another at a distance corresponding to the size of employed glass panes, so that the latter might be arranged in a regular grid-like pattern. In this manner any additional adjusting work at the construction site is avoided. The threaded bolts can either pass completely through the tubular struts for fastening simultaneously two U-shaped supports at opposite sides of each strut. The breadth of the yoke part of the U-shaped support corresponds approximately to the breadth of the narrow side of the strut. The fixing of the struts between the ceiling and floor construction parts is preferably obtained by using connection tubes fitting into the free ends of respective tubular struts, the connection tubes being secured at right angles to mounting plates which in turn are secured to the floor construction part and to the ceiling construction part. In this manner, during the installation of the partition wall, the connection tubes are inserted into the free ends of the struts, and after erection of the wall mounting plates are secured to the assigned construction parts. This arrangement has the advantage that the struts can be precut to a length which is slightly shorter than the clearance between the ceiling and floor of the room in which the partition is to be installed, and any construction tolerances of the framework can be easily compensated. The connecting tubes are secured to their mounting or anchoring plates by welding.

According to another feature of this invention, the mounting or anchoring plates are fastened to the assigned construction parts by means of anchoring bolts, preferably in the form of clamping or cemented anchors. The dimensioning and design of the entire connection to the construction parts of the framework, inclusive of the number of connection pieces and the dimensioning of the anchoring bolts, depends on local state of the foundation and on the static considerations. In any case, at least two anchoring bolts are used for each mounting plate, the bolts being provided at opposite major sides of the partition wall.

As a rule the lowermost and uppermost tie bars are situated in proximity to the upper edge of a floor supporting construction part, or to the lower edge of a ceiling-supporting, fire-resistant construction part. Also the extreme struts at the lateral sides of the partition are situated in proximity to the outer edges of the wall lining. In order to incorporate the dividing wall of this invention also in the ranges of the superstructure on the floor, in the substrate of a ceiling, and in the lining of plaster of lateral walls, there are provided plates of fire protection material as well as fireproof insulation arranged along the extreme parts of respective struts and tie bars in the plane of the glass panes. The thickness of the fire protection plates or panels is preferably about one half the breadth of the narrow sides of the struts or tie bars. The periphery of these fireproof plates or panels mostly directly contacts the adjoining struts and tie bars, whereas the sides of these panels which face the construction parts are spaced from the latter by means of the fireproof insulating straps, made preferably of mineral fibers.

In order to facilitate the installation of the fire protection dividing wall, there are provided spacing means attached to respective struts and engaging from opposite sides the end portions of the glass panes, preferably by means of interposed insulating straps. The spacing means are shaped of sheet metal pieces whose dimension is only a fraction of the height of the glass panes. It suffices when a single sheet metal spacer is assigned to each lateral side of the glass pane.

With advantage, the sheet metal spacers are attached to the struts by means of two bolts of the type having a hammer-shaped head. The head of each bolt is inserted through a keyhole-like opening in the narrow side of the tubular strut or tie bar, and upon turning through 90° is held in position by a tightening nut. The fireproof insulating straps are then applied between the holding arms of the metal sheet spacers and the inserted rim portions of the glass pane. Also in this case the insulating straps are made of mineral fibers. The keyhole-shaped openings are also formed in the struts and tie bars in advance in accordance with the standard size of the glass panes.

In a preferred embodiment, the spacers are of a U-shaped cross section with projecting end portions bent at right angles, so as to extend parallel to the major planes of the glass panes. In this manner, the secure clamping of the panes in the supporting frame is further enhanced.

To facilitate correct alignment of the covering rails on the outer surfaces of the supporting frame, the base surface of the covering rails is preformed according to the shape of the sheet metal spacers, so that the latter is fully embedded in the rails and insulated from the outside.

Even if the covering layers can be made of any material whose fire-resistant time factor corresponds approximately to that of the glass panes, in the preferred embodiment of this invention the covering rails are made of hard wood, particularly of mahogany. This kind of wood, apart from its fire protection quality, provides also due to its natural color and structure an aesthetic appearance for the entire partition. Preferably, the wooden covering rails extend continuously over the entire length of the struts, whereas the horizontal tie bars are covered by discrete sections of the rails. Similarly as all component parts of the partition, the covering rails are prefabricated so that their installation at the construction site does not encounter any difficulties.

With regard to the desired fire resistance time factor, the ratio of the breadth of the wooden covering rails to their height is in the range between 1.5:1 to 2:1.

An increased aesthetic effect is achieved when the covering layers have a substantially trapezoidal cross section. The outer surfaces of the rails can be further provided with ornamental grooves.

The installation and assembly of the covering rails is greatly facilitated when the top surface of the rails is provided with throughbores for receiving screw bolts which hold the spacing means for the glass panes to the struts and tie bars. Accordingly, no additional fastening means are necessary for fixing the covering rails to the partition. Only an additional nut and washer is needed, which tightens the rails against the spacer means. The ends of throughbores in the range of the upper surface of the covering rails are extended in diameter so as to accommodate the free end of the fastening bolt and the corresponding nut. The resulting recess of larger diameter is then filled up with a fire-resistant insulating material, which again is preferably made of mineral fibers so as to shield the fastening bolts against the effects of a fire. For aesthetic appearance and also to prevent the insulation from falling out, the recesses are closed by a wood plug, preferably in the form of a wooden plate which is simply pressed in the recess.

The gap between the bottom side of the covering rails and the glass panes is sealed by a sealing mass, such as silicon rubber.

In the marginal range of the partition, there are provided hard wood straps clamped between the outermost covering layers and the opposite surfaces of the floor, wall lining and ceiling of the construction. These hard wood straps are spaced apart from the peripheral insulating panels by means of wooden blocks for example. If desired, these marginal straps can be made also of another insulating material. Depending on the particular conditions of the space where the partition is installed, the marginal straps can be in the form of continuous or discrete wooden plates, or other wooden sections. The corner areas between the marginal straps and the adjoing surfaces of the construction can be covered by a molding of corresponding cross section. Also the spacer blocks between the marginal strips and the underlying insulating panels can be made of another kind of insulating material, for example of mineral fibers.

The covering rails themselves can be with advantage covered with a metal or other coating. The purpose of this coating is to adjust the partition wall to different architectonic requirements when dividing a space of a structure into fire protection sections. The color and shape of the coatings is selected so as to match the particular environment.

According to still another feature of this invention, the outer sides of the struts and tie bars are coated with a fire protection paint which contributes to the equalization of the fire resistance of the covering rails in the range of gaps between the upright struts and the horizontal tie bars. Preferably, such fire protection paint has the quality that, in the case of fire, it starts to swell and seals these gaps.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
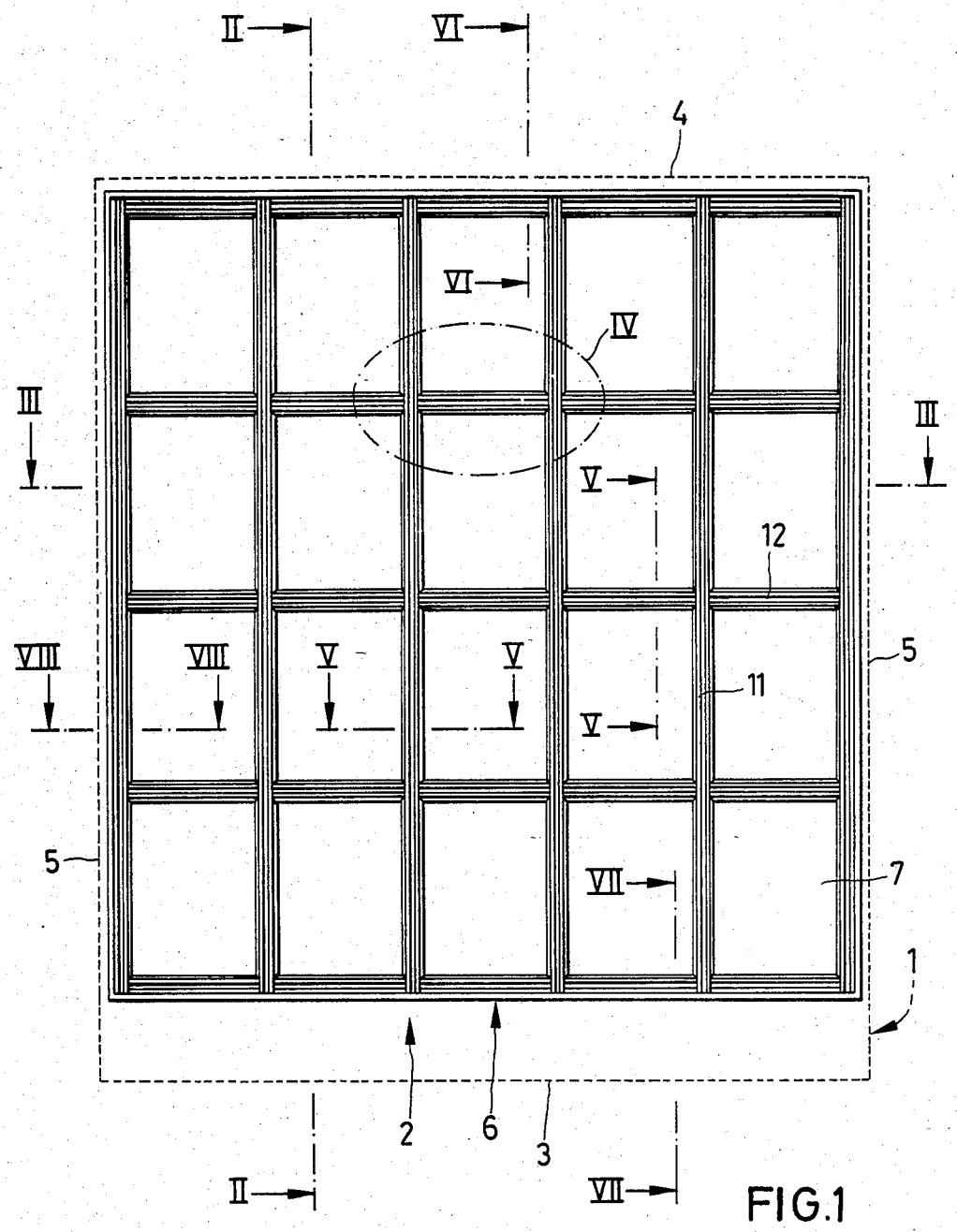
FIG. 1 is a front view of a fire protection dividing wall of this invention.
Figure 2:
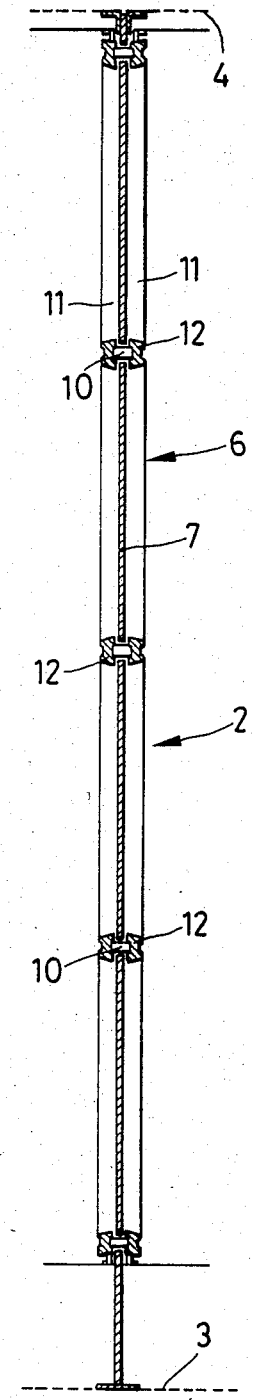
FIG. 2 is a vertical section of the dividing wall of FIG. 1, taken along the line II—II.
Figure 3:
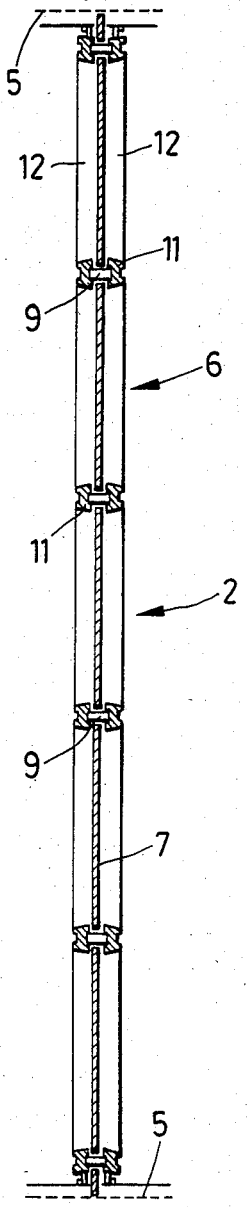
FIG. 3 is a view of a horizontal section of the dividing wall of FIG. 1, taken along the line III—III.

Referring firstly to FIGS. 1–3, reference numeral 1 indicates the contour line of a room, shown in a vertical front view, which is to be divided by a fire protection partition 2 into two separate sections. Reference numeral 3 indicates the upper edge of a floor construction part; reference numeral 4 the lower edge of a ceiling construction part; and the outer edges of the lateral wall of the framework of a building are indicated by reference numeral 5. The fire protection dividing wall 2 consists of a supporting frame 6 which, as will be explained in greater detail below, is clamped between the construction parts 3–5, and supports a plurality of fire protection glass panes 7 fixedly arranged in the supporting frame 6.

Figure 4:
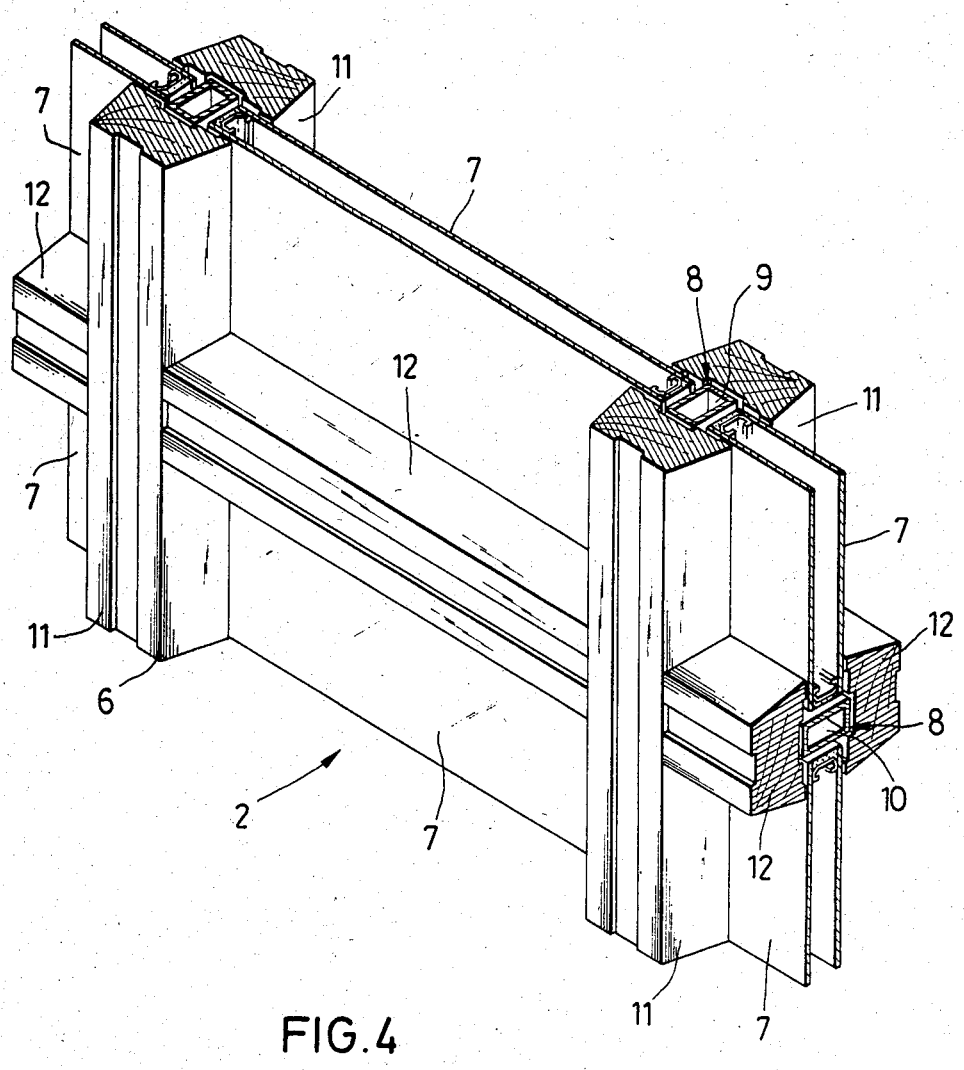
FIG. 4 is a perspective view of a cut away part IV of FIG. 1, shown on an enlarged scale.

From FIG. 4 and in connection with FIGS. 1–3, it will be seen that the supporting frame 6 includes a core 8 made of rectangular steel tube sections. The core 8 consists of upright struts 9 and horizontal tie bars or tubes 10. The struts 9 extend continuously from the floor-supporting construction part up to the ceiling-carrying construction part, whereas the tie bars 10 extend in horizontal directions between respective struts 9. At both major sides of the partition 2 the struts 9 and the tie bars 10 are covered by covering rails 11 and 12, made of hard wood, particularly of mahogany. The length of covering rails 11 and 12 corresponds to the length of the struts 9 and tie bars 10. That means, the covering rails 11 assigned to the struts 9 are uninterrupted over their entire length in vertical direction, whereas the covering rail sections assigned to the tie bars 10 are positively connected to the vertical rails 11.

Figure 5:
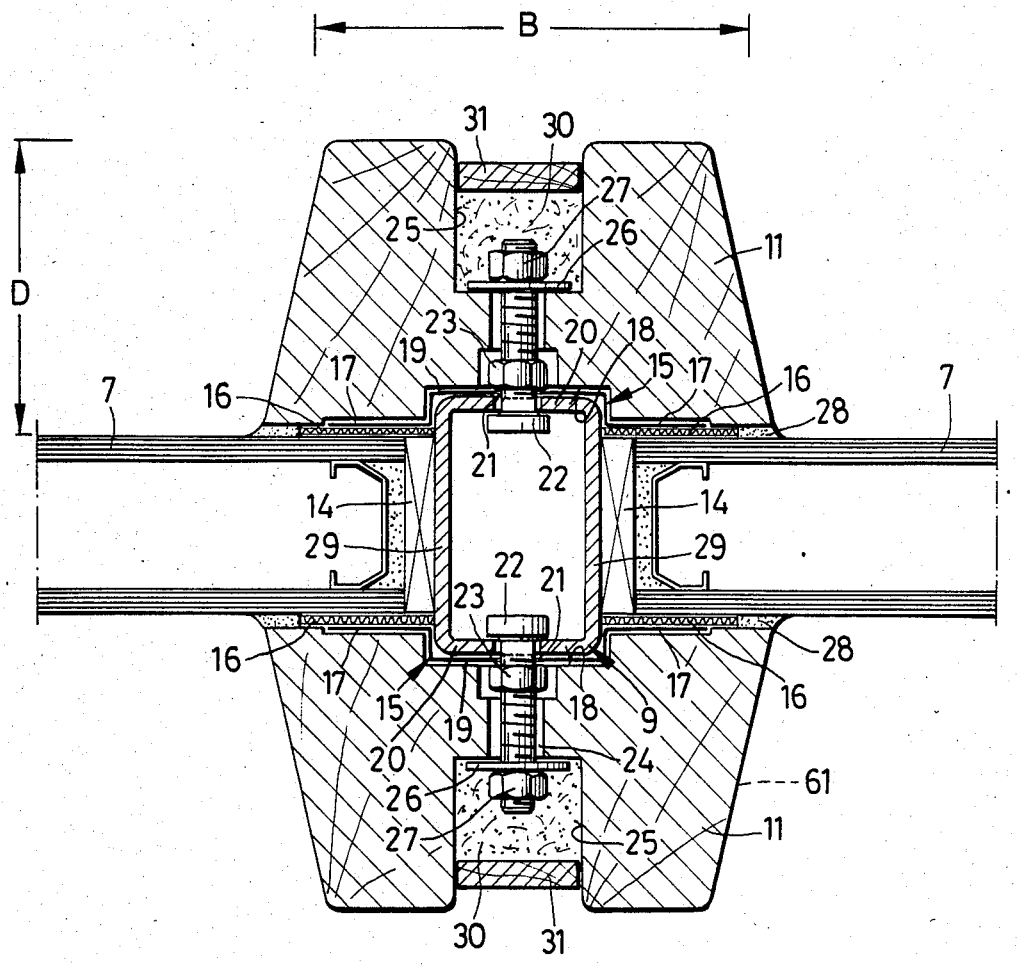
FIG. 5 is a sectional side view of a part of the dividing wall of FIG. 1, taken along the line V—V and shown on an enlarged scale.
Figure 6:
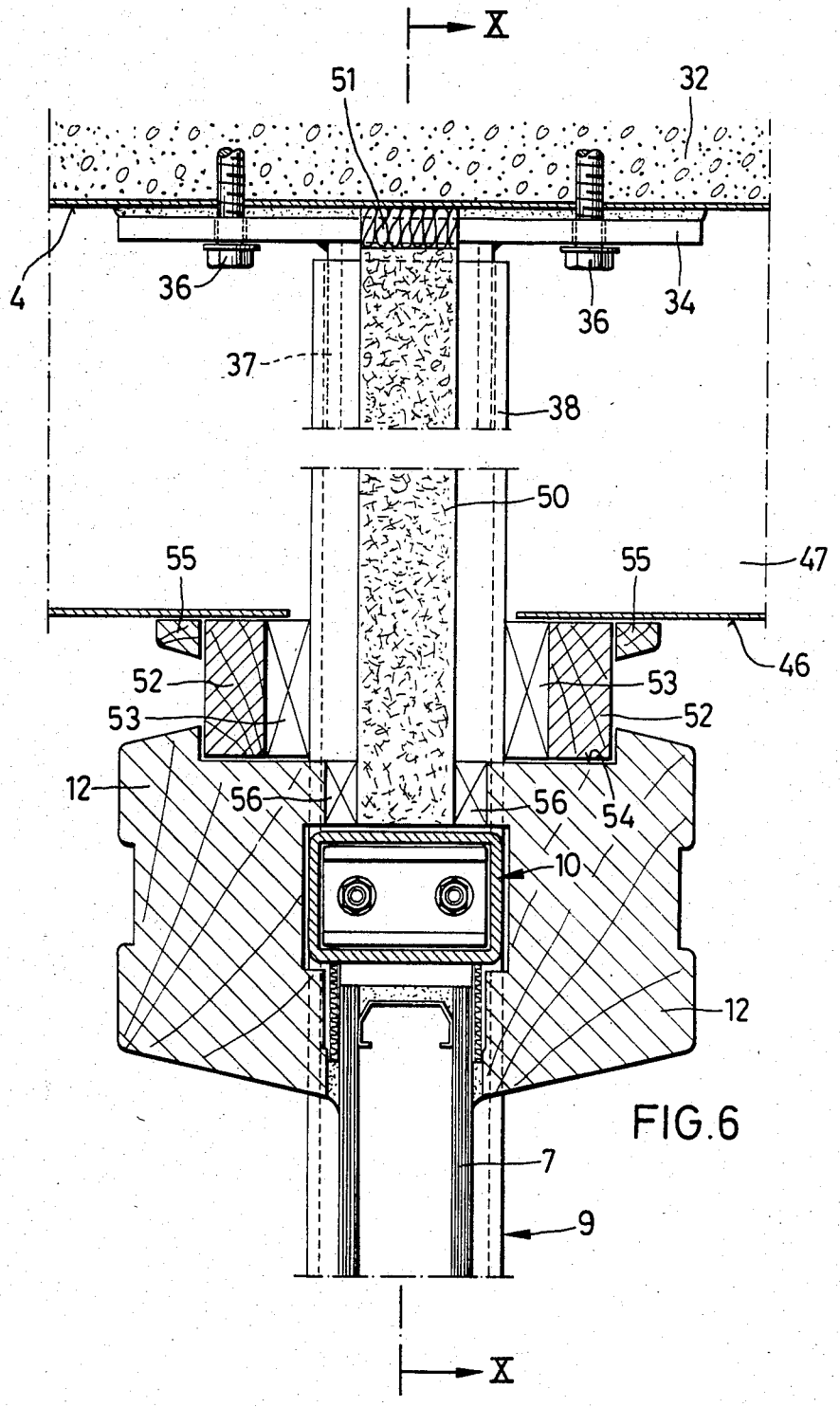
FIG. 6 is a vertical section of the dividing wall of FIG. 1, taken along the line VI—VI.
Figure 7:
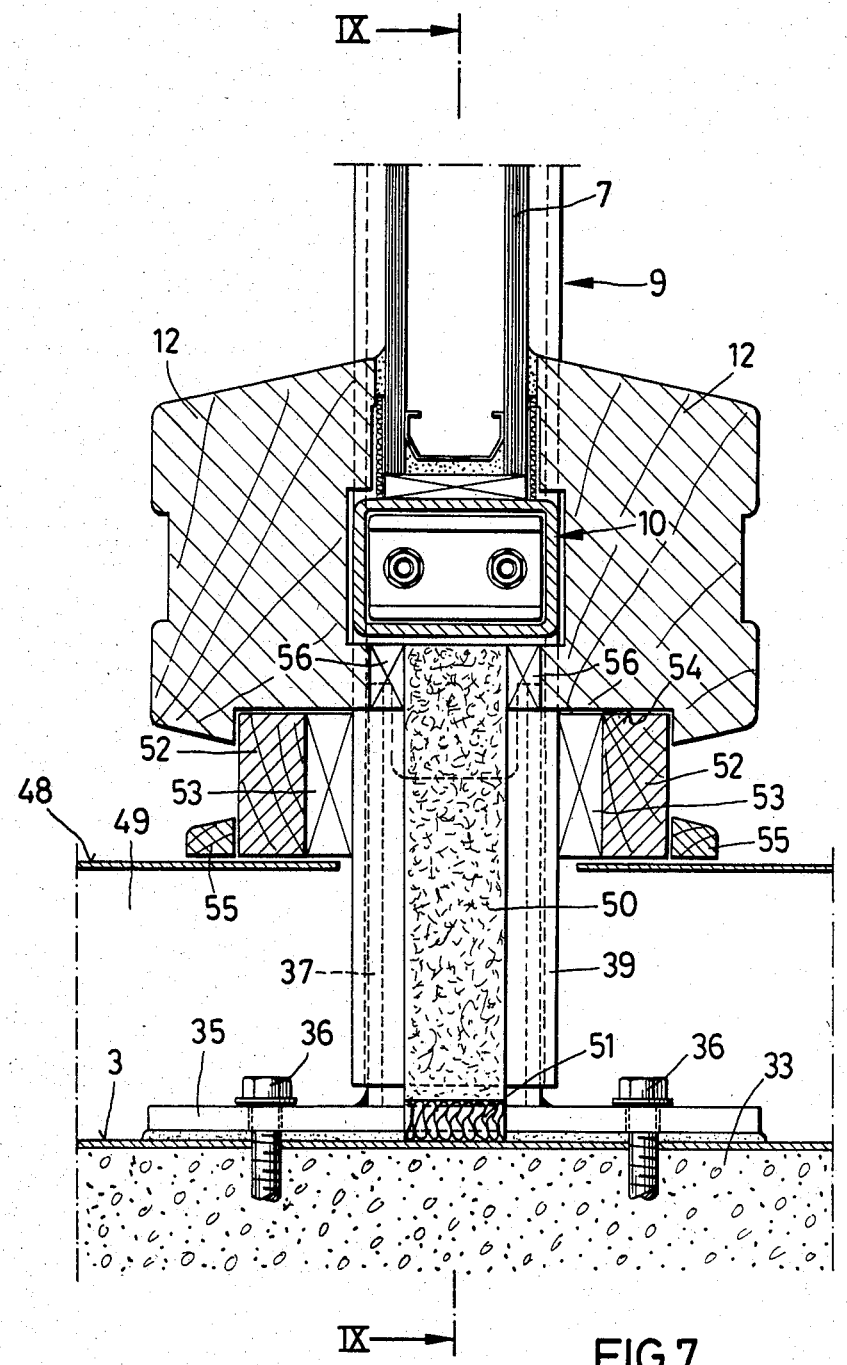
FIG. 7 is a vertical section of a part of the dividing wall of FIG. 1, taken along the line VII—VII.
Figure 9:
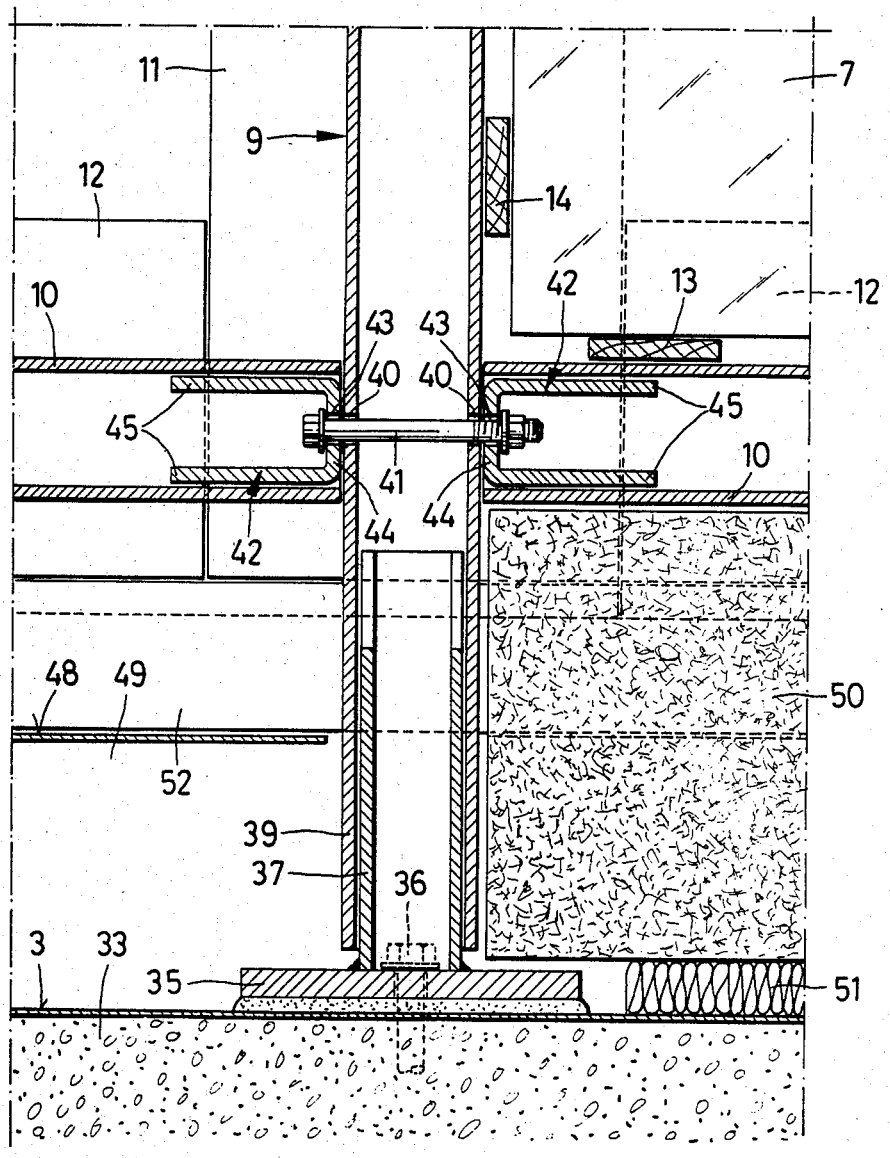
FIG. 9 is a sectional front view of the part of the dividing wall shown in FIG. 7, taken along the line IX—IX.

FIG. 5 illustrates in greater detail the fixing of the fire protection glass panes 7 to the struts 9 and tie bars 10, and also shows the attachment of the covering rails 11 and 12 to the supporting frame. A strut 9 with assigned vertical covering rails 11 is shown in a plan section. The fixing of glass panes 7 to horizontal tie bars or tubes 10 is identical. The fire protection glass planes 7, as will be seen particularly from FIGS. 5 and 9, are held in a spaced relationship relative to the strut 9 and the tire bars 10 by means of wooden setting blocks 13 and lateral wooden spacers 14. The attachment of the wooden setting blocks and spacers to the struts and tie bars is accomplished initially by means of U-shaped spacer holders 15 made of bent sheet metal and by means of insulating straps 16 of mineral fibers applied between the marginal portions of the glass panes and the spacer holders. The actual spacers are formed by bent flanks 17 of the U-shaped holders 15. The latter are embedded in correspondingly shaped recesses in the base side of the covering rails 11. The U-shaped central part 19 of the spacer holders embraces the narrow sides 20 of the struts 9. The connecting or yoke part of the U-shaped profile of the spacers 9 is attached to the narrow sides of the struts by means of hammerhead bolts 22 which are inserted in a keyhole-shaped openings in the narrow side of the strut and upon turning of the head through 90° are secured together with the spacer holder 15 by means of a nut 23 so as to hold the glass pane 7 in a fixed position.

It will be also seen from FIG. 5 that the free ends of hammerhead bolts 22 pass through bores 24 in the covering rails 11 and project into a recess 25 of larger diameter provided in the top side of each covering rail, the latter being of trapezoidal cross section. By means of a wafer 26 and an additional nut 27, the covering rails are firmly secured to the underlying struts 9. The connection gap between the covering rails 11 and 12 and the glass pane 7 is sealed by an insulating mass 28.

It will be also recognized from FIG. 5 that the ratio of the breadth of narrow sides 20 of the steel pipes 9 and 10 to the breadth of the broader sides 29 is about 2:3. The wall thickness of the steel tube sections corresponds approximately to 1/10 of the breadth of the narrow sides 20. The breadth B of the longitudinal sides of the covering rails 11 and 12 to the thickness D of the latter is about 1.5:1 to 2:1.

To protect the screwbolts 22, the recesses 25 are filled with mineral fibers 30 and covered by wood plugs 31.

FIGS. 6, 7, 9 and 10 illustrate the anchoring of respective struts 9 to the ceiling-carrying construction part 32 and to the floor-supporting construction part 33. For this purpose, there are provided anchoring plates 34, 35 which are secured to the construction parts 32 and 33 by anchoring bolts 36. Each anchoring plate 34, 35 is provided with a connection sleeve 37 connected thereto at right angles by welding. The connection sleeves 37 fit snugly in the assigned end portions 38 and 39 of respective tubular struts 9. The length of the struts 9 is preferably slightly shorter than the clearance between the upper anchoring plate 34 and the lower anchoring plate 35, so as to compensate for structural tolerances of the construction.

Figure 10:
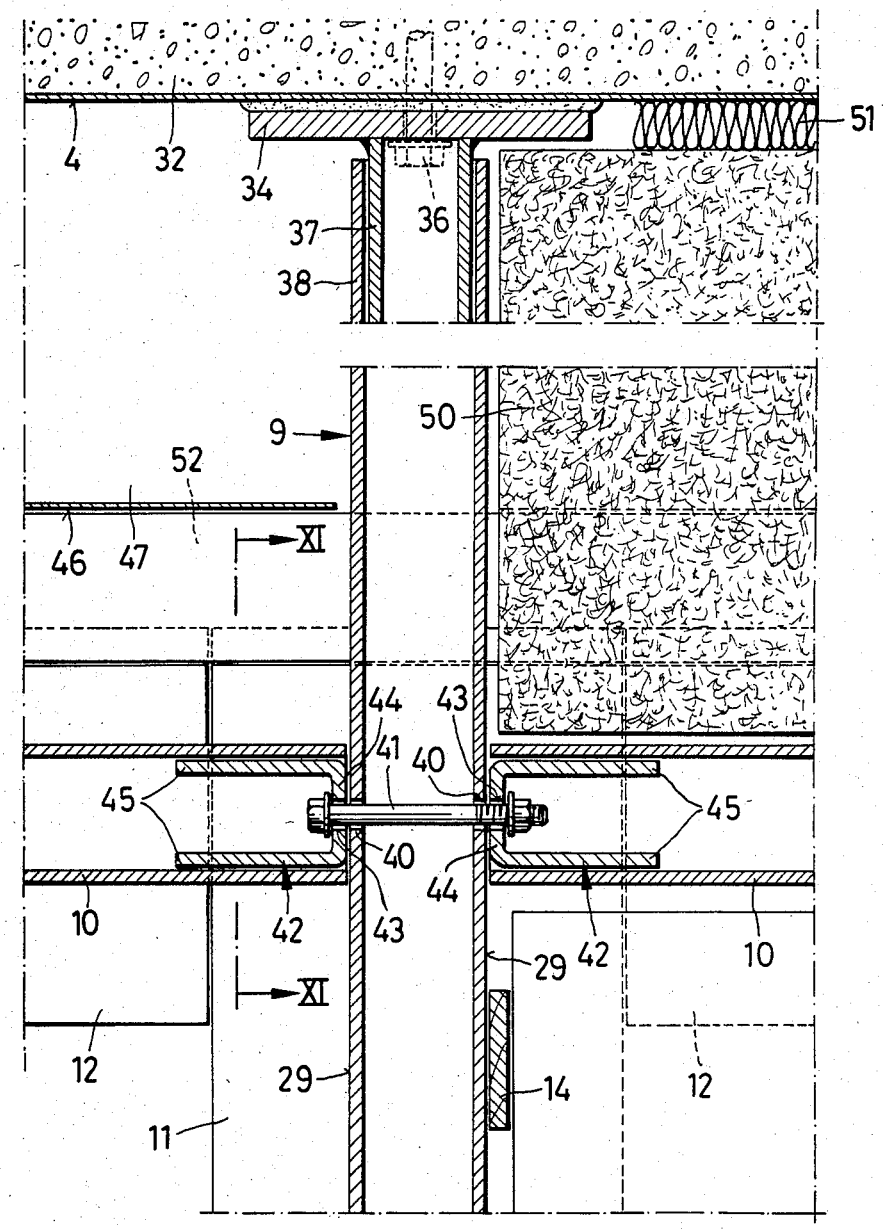
FIG. 10 is a vertical front section of the part of the dividing wall illustrated in FIG. 6, taken along the line X—X.
Figure 11:
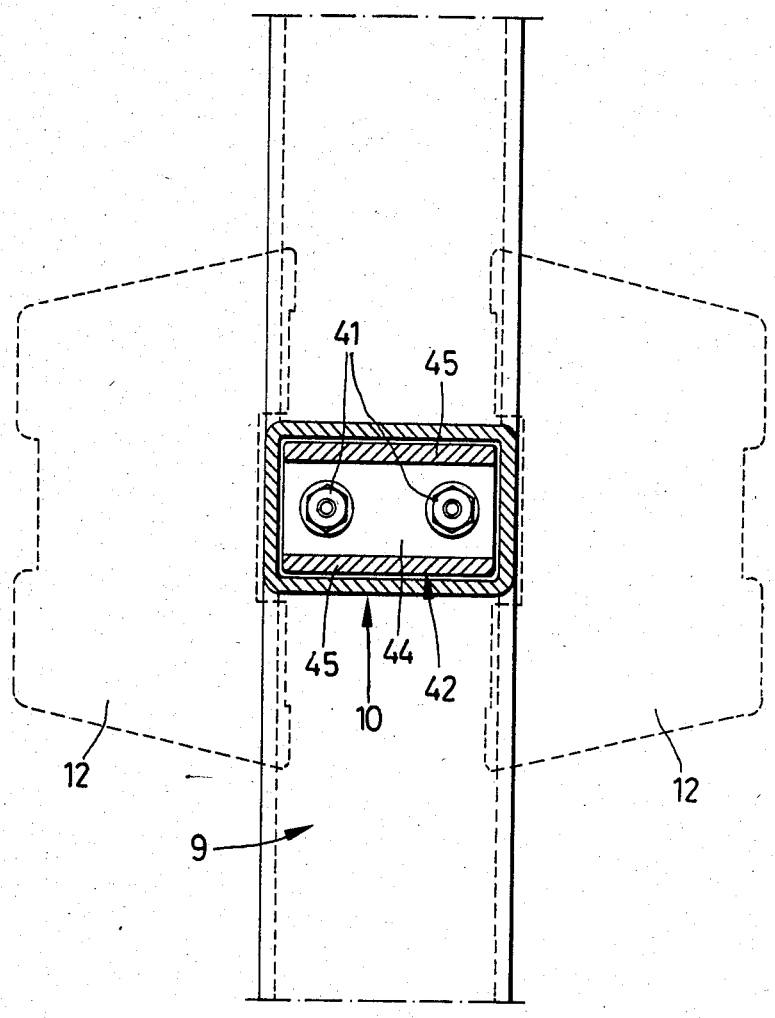
FIG. 11 is a vertical transverse section of a cut away part of the dividing wall of FIG. 10, taken along the line XI—XI.

FIGS. 9–11 illustrate the connection of a tie bar or tube 10 with the upright struts 9. For this purpose, there are provided openings 40 in opposite narrow walls of each strut to receive screwbolts 41 for fastening U-shaped projections 42. It will be seen from FIG. 11 that the openings 40 are formed in pairs side-by-side and spaced apart in vertical direction by a distance sufficient for accommodating the superposed standard glass panes. In the range of these openings, there are secured by means of hexagonal bolt and nuts 41, supporting pieces 42 of U-shaped cross section which in the yoke part 34 are formed with a corresponding pair of openings 43 for the bolts 41. The projecting arms 45 of the supporting piece 42 are dimensioned to fit tightly in the interior of horizontal guide tubes 10. The length of these arms 45 corresponds substantially to the breadth of the broader sides of the steel tube sections used for the struts and tie bars. After securing the U-shaped supporting pieces 42 in position on the struts 9, the horizontal tie tubes 10 are simply inserted thereon, and a complete grid-like structure of the core 8 of the supporting frame 6 will result.

FIGS. 6, 7, 9 and 10 illustrate the means and measures which are to be taken for filling up the gaps between the end parts of respective struts and horizontal tie tubes and the supporting construction parts of the framework of the building, and also between the lower edge 46 of the ceiling construction part 47 or the upper edge 48 of the floor construction part 49, and also between the component parts 32 and 33. These marginal regions are filled up by panels 50 of an insulating, fire protection material disposed between the tie tubes 10 and a strip 51 of insulating mineral fibers which are in contact with the construction parts 32, 33 of the framework. Since the covering rails 12 terminate as a rule close below the ceiling-supporting structure 47 or close above the floor supports 49, there are provided hard wood straps 52 for bridging these interspaces. The strips 52 are spaced apart from struts 9 by wooden spacing blocks 53. These edging strips 52 engage recesses 54 in the lowermost and uppermost covering rails 12. The corners between the hard wood straps 52 and the ceiling or floor construction parts 47 and 49 are covered by profiled straps 55. Spacing pieces 56 are also provided between the covering rails 12 and the panels 50.

Figure 8:
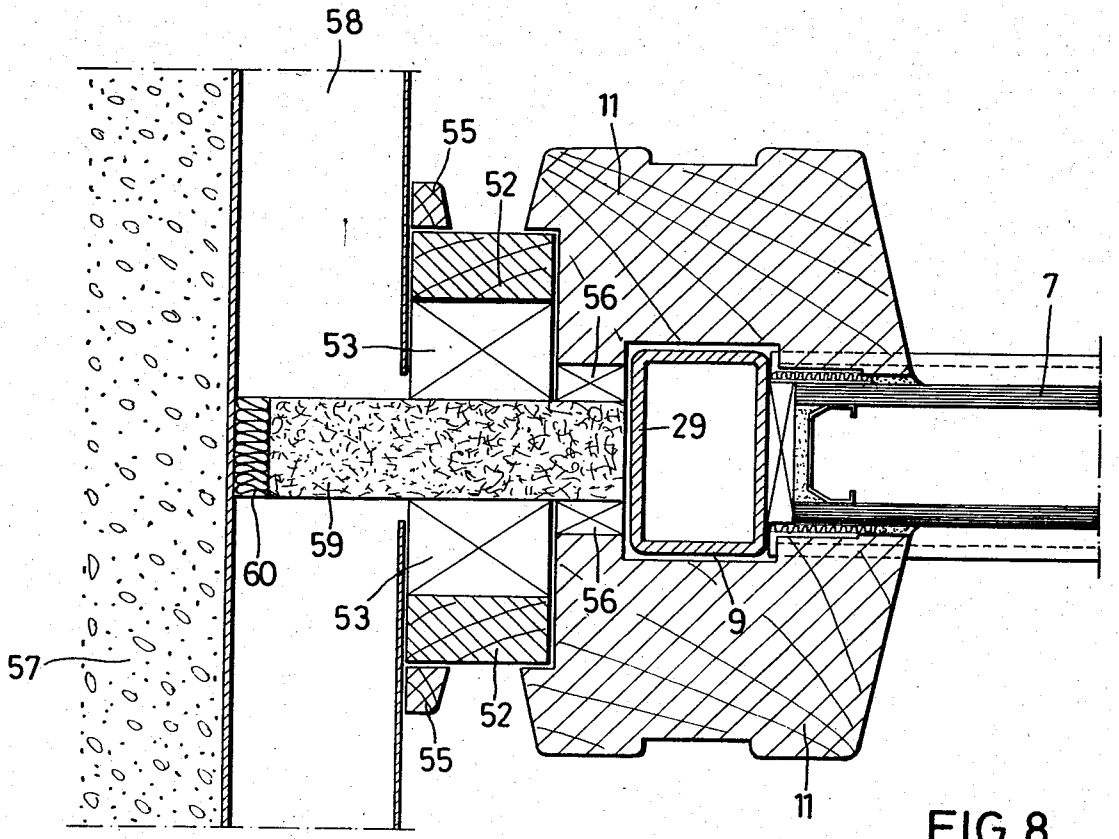
FIG. 8 is a horizontal section of a part of the dividing wall of FIG. 1, taken along the line VIII—VIII.

In principle, the same arrangement of fireproof panels is provided in the regions between the lateral struts 9 and the wall framework 57 (FIG. 8). The wall lining or plaster 58 encloses again a panel-like element 59 of hard wood, which at one end engages the longitudinal side 29 of the strut 9, and at the opposite end it is connected via an insulating mineral fiber strap 60 to the wall frame 57. Also in this case, strips 52 of hard wood and profiled strips 55 are used, which are supported through spacer blocks 53 on the panel element 59. The latter panel elements 59 are also supported via spacer pieces 56 on the covering rails 11.

If desired, the covering rails 11 can be provided with a jacket 61 of a metallic or non-metallic layer as indicated by reference numeral 61 in FIG. 5.

It will be understood that each of the elements described above, or two or more together, may also find a useful application in other types of constructions differing from the types described above.

While the invention has been illustrated and described as embodied in a specific example of a fire protection dividing wall, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fire protection dividing wall, wherein said covering rails have a bottom side formed with step-like recesses for accommodating said U-shaped holding means.

2. A fire protection dividing wall as defined in claim 1, wherein said covering rails are made of hard wood sections secured to the outer sides of said struts and horizontal tie bars.

3. A fire protection dividing wall as defined in claim 1, wherein the ratio between the breadth and the thickness of said covering rails is between 1.5:1 and 2:1.

4. A fire protection dividing wall as defined in claim 1, wherein the covering rails have a trapezoidal cross section.

5. A fire protection dividing wall as defined in claim 1, wherein the covering rails are secured to the assigned struts or horizontal tubes by the same screwbolts as are said holding means.

6. A fire protection dividing wall as defined in claim 2, further comprising hard wood border strips arranged between the marginal covering rails and the opposite construction parts of the building.

7. A fire protection dividing wall as defined in claim 6, further comprising wooden spacers provided between the hard wood border strips and the end parts of the struts or tie tubes in the range of said insulating panels.

8. A fire protection dividing wall for use in connection with construction parts of a framework or foundation of a building, comprising a supporting frame; at least one fire protection glass pane attached to said frame by means of peripheral insulation means and by a sealing mass applied in the gap between the glass pane and the frame; said frame including a steel core assembled of upright struts engageable between two opposite construction parts, and of horizontal tie bars arranged between the upright struts to support said glass pane; covering rails provided at opposite outer sides of the core to cover the joints between said struts and said tie bars, said covering rails overlapping the edges of said glass pane and being made of a material which has approximately the same fire resistance time factor as said glass pane; holding means attached at opposite sides of said struts and of said horizontal tie bars to hold said glass pane in position in said frame, and insulating means provided between said holding means and said glass pane; said holding means being secured to respective struts and/or horizontal tie bars by screwbolts and haing a U-shaped central portion fitting outer sides of said struts, and laterally projecting wings extending parallel to a central plane of the dividing wall; said covering rails having a bottom side formed with step-like recesses for accommodating said U-shaped portion of the holding means and being secured to the assigned struts or tie bars by the same screwbolts as are said holding means, and wherein said screwbolts have a hammer-like head insertable in a keyhole-like opening in the strut or tie tube, said holding means being fastened by one nut and said covering rails being fastened by another nut on said screwbolt.

9. A fire protection dividing wall as defined in claim 8, wherein the top side of said covering rail is formed with an additional recess for accommodating the end part of said screwbolt and said another nut.

10. A fire protection dividing wall as defined in claim 9, wherein said additional recess is filled with a fireproof insulating material.

11. A fire protection dividing wall as defined in claim 9, wherein said additional recess is closed with a plug arranged in the plane of said top side.

12. A fire protection dividing wall as defined in claim 11, wherein said plug is a disk of hard wood.

13. A fire protection dividing wall for use in connection with construction parts of a framework or foundation of a building, comprising a supporting frame; at least one fire protection glass pane attached to said frame by means of peripheral insulation means and by a sealing mass applied in the gap between the glass pane and the frame; said frame including a core assembled of one-piece upright struts engageable between two opposite construction parts, and of uniform horizontal tie bars arranged between the upright struts to support said glass pane, said struts and tie bars being made of metal tubular sections of rectangular cross section defining narrow and broad sides, whereby a center plane passing through the broad sides coincides with a center plane of said dividing wall; said struts being provided with uniformly spaced projections fitting the interior of the end portions of said tubular tie bars; anchoring plates secured to the opposite construction parts of the building, said anchoring plates being integral with connection sleeves insertable into the end portions of the assigned tubular struts; holding means attached at opposite narrow sides of said struts to hold said glass pane in position in said frame; insulating means provided between said holding means and said glass pane; and covering rails provided at opposite outer sides of the core to cover the joints between said struts and said tie bars, said covering rails overlapping the edges of said glass pane and being made of a material which has approximately the same fire resistance time factor as said glass pane.

14. A fire protection dividing wall as defined in claim 13, wherein said sealing mass is applied into the gaps between said covering rails and said glass pane.

15. A fire protection dividing wall as defined in claim 13 further comprising spacing elements provided between the broad sides of said struts and the bars and the edges of said glass pane.

16. A fire protection dividing wall as defined in claim 15 wherein said spacing elements are wood spacers.

17. A fire protection dividing wall as defined in claim 13 wherein each strut is made of a one piece steel tube section.

18. A fire protection dividing wall according to claim 14, wherein said struts and tie bars are made of steel tube sections.

19. A fire protection dividing wall as defined in claim 18, wherein the ratio of the narrow side to the broad side of each tubular section is about 2:3.

20. A fire protection dividing wall as defined in claim 19, wherein the wall thickness of respective steel tube sections corresponds approximately to a tenth of the size of the narrow sides.

21. A fire protection dividing wall as defined in claim 14, wherein the projections are in the form of U-shaped supports fastened to the assigned strut by screwbolt connections.

22. A fire protection dividing wall as defined in claim 13, wherein the length of each projection corresponds approximately to the breadth of the broad side of the tubular sections.

23. A fire protection dividing wall as defined in claim 14, wherein said anchoring plates are secured to the assigned construction parts by anchoring bolts, particularly in the form of clamping or cemented anchors.

24. A fire protection dividing wall as defined in claim 13, further comprising panels of a fire protection material, said panels being arranged in the peripheral region of the supporting frame between the lateral struts and the opposite construction parts and between the uppermost and lowermost tie bars and the opposite construction parts.

25. A fire protection dividing wall as defined in claim 24, comprising fire-resistant insulation straps inserted between said panels and the opposite construction parts.

26. A fire protection dividing wall as defined in claim 14, wherein said holding means are secured to respective struts and/or horizontal tie bars by screwbolts.

27. A fire protection dividing wall as defined in claim 26, said holding means having a U-shaped central portion fitting said narrow sides of the steel tubes, and laterally projecting wings extending parallel to a central plane of the dividing wall.

28. A fire protection dividing wall as defined in claim 13, wherein said covering rails are provided with a metallic or non-metallic coating.

29. A fire protection dividing wall as defined in claim 13, wherein said horizontal tie bars are coated with a fire-resistant paint.

* * * * *